United States Patent [19]

Tuckey

[11] 4,001,354

[45] Jan. 4, 1977

[54] COVER PLATE FOR A CARBURETOR BODY

[75] Inventor: Charles H. Tuckey, Cass City, Mich.

[73] Assignee: Walbro Corporation, Cass City, Mich.

[22] Filed: Nov. 17, 1975

[21] Appl. No.: 632,277

[52] U.S. Cl. ..... 261/35; 261/DIG. 68; 220/327

[51] Int. Cl.[2] ..... F02M 17/04

[58] Field of Search ..... 261/DIG. 68, 35; 292/251; 220/327

[56] References Cited

UNITED STATES PATENTS

| | | | |
|---|---|---|---|
| 183,861 | 10/1876 | Mertens | 292/251 |
| 502,005 | 7/1893 | Shaw et al. | 220/327 |
| 1,251,676 | 1/1918 | McCaffray | 292/251 |
| 1,463,147 | 7/1923 | Hillmer | 292/251 |
| 2,027,083 | 1/1936 | Baer | 220/327 |
| 2,420,318 | 5/1947 | Leonard et al. | 220/327 |
| 2,715,152 | 8/1955 | Balzer | 220/327 |
| 3,262,433 | 7/1966 | Jordan | 261/DIG. 68 |
| 3,743,253 | 7/1973 | Schneider et al. | 261/DIG. 68 |
| 3,758,084 | 9/1973 | Tuckey | 261/DIG. 68 |

*Primary Examiner*—Tim R. Miles

*Attorney, Agent, or Firm*—Barnes, Kisselle, Raisch & Choate

[57] ABSTRACT

A cover plate for a carburetor having a gasket interposed between the plate and the carburetor body which comprises a plate of rectilinear shape with a bottom peripheral surface to seal against the gaskets on a carburetor body and having a central upstanding boss on the outside of the plate with tapered ribs extending from the top of said boss to the corners of the plate. A screw with a tapered head passes through a tapered opening in said boss and exerts pressure on said ribs to urge the entire plate in tight contact with the carburetor body.

5 Claims, 3 Drawing Figures

COVER PLATE FOR A CARBURETOR BODY

This invention relates to a carburetor body construction and more particularly to a cover plate for a carburetor body which has an improved overall design and retaining means.

Small carburetors that are used in chain saws and other small engines have been decreasing in size because of the demands for smaller units to fit within small hand-held chain saws.

There has also been pressure on the manufacturers of carburetors to reduce the cost of these carburetors because of the keen competition in the field. It is also desirable that servicing of the carburetors be accomplished in as expedient a manner as possible and that the number of parts in a carburetor be reduced.

With this in mind, the present invention has as its object the provision of a cover plate for a portion of the carburetor which is held on by a single screw while yet retaining all of the sealing properties that are required. The reason for this is that the cover plates are applied over diaphragms and sealing gaskets; and it is important that they be sealed around the periphery with a positive clamping pressure.

A carburetor of the type under consideration is shown in U.S. patent to Charles H. Tuckey and Kenneth C. Schneider, U.S. Pat. No. 3,743,253, issued July 3, 1973, and assigned to the assignee of the present application. This patent shows a carburetor in which a pump chamber and a fuel inlet are provided on one side of the carburetor body. Between the cover plate and the carburetor body are diaphragms and sealing gaskets. Previous construction has utilized a screw in each of the four corners of the cover plate to insure that it is properly clamped to the body.

The above-mentioned patent shows a plate held by a single center screw. This has proved to be satisfactory when the cover is very small. The present invention contemplates a cover plate and single screw assembly which provides for the proper seal between the plate and the carburetor body when the cover spans a larger area. A carburetor similar to the one to be disclosed herein is also disclosed in a copending application of Charles H. Tuckey and Luis B. McNulty, Ser. No. 609,990, filed Sept. 3, 1975, assigned to the assignee of the present application.

It is, therefore, an object of the present invention to provide a cover plate for one side of a carburetor body which will seal effectively around its periphery as well as centrally and which is held in place by a single screw.

Other objects and features of the invention will be apparent in the following description and claims in which the principles of the invention are set forth together with the details of construction and operation in connection with the best mode presently contemplated for the practice of the invention.

Figure 1:
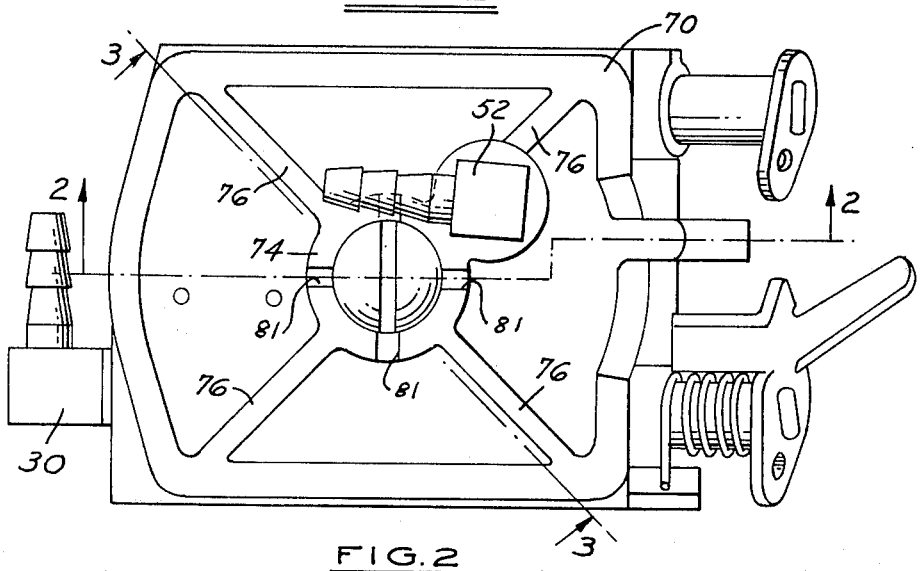

Drawings accompany the disclosure and the various views thereof may be briefly described as:

FIG. 1, a top view of a carburetor incorporating the present invention.

Figure 2:
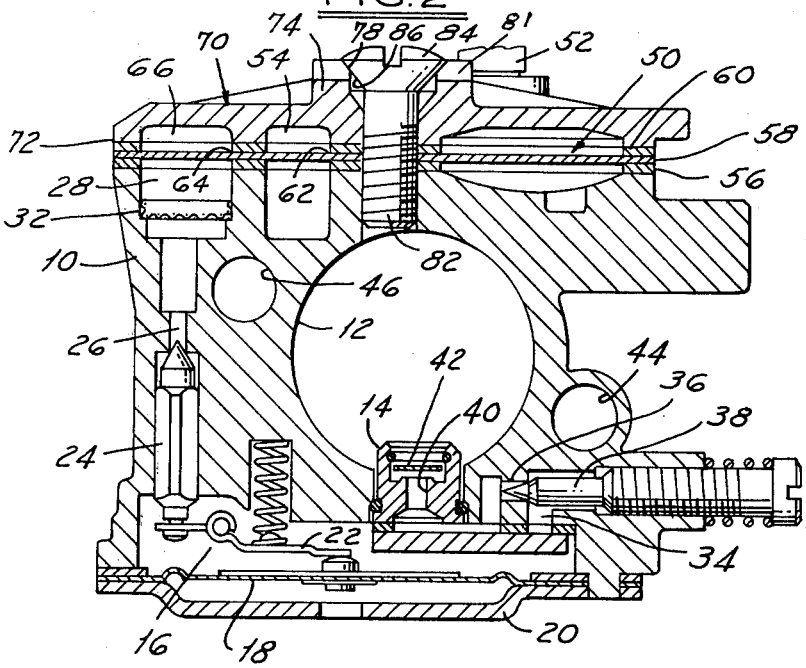

FIG. 2, a sectional view on line 2—2 of FIG. 1.

Figure 3:
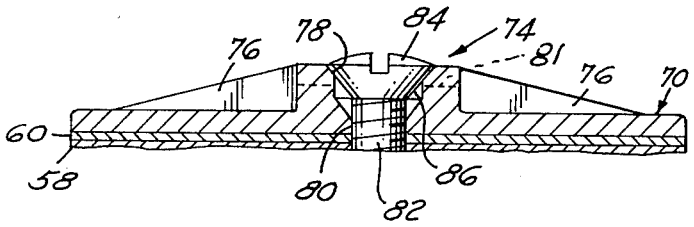

FIG. 3, a sectional view on line 3—3 of FIG. 1.

With reference to the drawings, the carburetory body 10 has a venturi opening 12 with a main jet insert 14 opening into the venturi. A diaphragm chamber 16 at the bottom of the carburetor body is formed by the bottom of the body 10 and a diaphragm 18 held in place by a cover plate 20. The diaphragm controls a spring biased lever 22 which in turn controls an inlet valve 24 seated in one end of an opening 26.

A fuel supply chamber 28 receives fuel from a pumping system (later described) having its source at an inlet connector 30 (FIG. 1), the fuel passing through a filter 32 to the valve seat passage 26. Fuel from the diaphragm chamber 16 flows through a passage (not shown) to reach a port 34 leading to a short passage 36 controlled by a needle valve 38. Fuel flows from the control passage to an opening 40 in the main jet insert 14. A check valve 42 is provided in the main jet insert to prevent backflow during an idle condition of the carburetor. The idle passages for this particular carburetor are not shown although they would be of standard construction. Holes 44 and 46 are provided to bolt the carburetor body to an engine.

At the top of the carburetor are various chambers which form a pumping system for the carburetor. A pump chamber 50 receives pulses from a connector 52 which would be connected to the crankcase of an engine. A pulsing chamber 54 is provided in the pumping system and the fuel ultimately reaches the chamber 28 where it is controlled by the valve 24. There are a plurality of gaskets and diaphragms in the assembly. A first sealing gasket 56 is applied directly to the body; a diaphragm 58 overlies this base gasket, this diaphragm having valve flaps on it in a standard construction, and a top gasket 60 overlies the diaphragm 58. It is important that these gaskets be sealed not only at the periphery but also at the center portion 62 and the other portions such as that shown at 64.

As previously explained, this top plate has been held by four corner screws. An attempt to use the center screw has proved to have disadvantages in obtaining the desired sealing with the larger area cover plate.

According to the present invention, the top plate 70 is provided with the necessary chambers 50, 54, 66 for the pumping system of the carburetor and has a peripheral edge 72 which extends around the entire gasket assembly.

It will be seen that the plate 70, which is oblong in shape, is provided with a raised center boss 74 and four diagonally extending, triangular, force-transmitting ribs 76 which extend to the corners of the plate 70, these ribs starting at the top of the raised center boss 74 and extending downwardly to the corners of the plate.

It will be noted in FIGS. 2 and 3, that the boss 74 has a recess 78 which extends downwardly and inwardly from the top of the boss to a cylindrical screw opening 80. The recess 78 has a small conical chamfer at the top periphery which leads to a descending wall which tapers to the screw opening 80. The boss 74 also has four short slots 81 through the wall of the boss spaced between the ribs 76. These slots facilitate the action of the holding screw to be described.

The slotted screw which holds the plate in place has a threaded shank 82 and a slotted head 84. The lower region of the screw head 86, FIG. 3, preferably has a taper with an included angle which matches or is wider than that of the included angle of the chamfer at the top of recess 78. With this arrangement, the screw head 84 is designed and dimensioned to contact the wall of the recess 78 at the area of the chamfer at the topmost portion of the boss 74.

Thus, when the plate 70 is assembled and the screw 82 is tightened, the head of the screw will exert an outward camming pressure at the top of the boss which in turn transmits through the ribs 76 to the outer corners of the plate 70. The slots 81 allow the slight radially outward expansion which insures proper transmission of the clamping force to the periphery of the plate. With this arrangement, there is a tight seal obtained centrally of the plate, and the periphery of the plate is also forced downwardly by the action of the ribs 76 to obtain a tight peripheral seal around the entire plate. Thus, with a single screw, the plate can be securely clamped to the carburetor body in a manner to seal all of the chambers at the pumping end of the carburetor on both the outside and the inside peripheries.

I claim:

1. A cover plate for a carburetor body in which sealing gaskets are provided between the plate and the body which comprises:

a. a rectangular, relatively-flat plate having peripheral and other bottom surfaces to contact a gasket interposed between the plate and the body, b. an upstanding boss formed on said plate rising above the general surface thereof, said boss having an opening to receive a holding screw, c. a plurality of spaced ribs on the top surface of said plate and integral with said boss and plate and extending from the top portion of said boss centrally of said plate to the periphery at the corners of said plate raised above the general surface of the plate and extending to the outer edges, and d. a holding screw having a head with a surface to contact and apply a radial outward camming force on the upper portion of the wall of said opening in said boss and on said ribs to hold said plate on said carburetor when said screw is moved axially into said body.

2. A combination as defined in claim 1 in which the opening in said boss is formed with a tapered camming surface adjacent the top end thereof for contact with the head of a holding screw.

3. A combination as defined in claim 1 in which the screw has a tapered region below the top surface thereof merging with the shank of the screw, said tapered region serving to contact the wall of said opening in said boss.

4. A combination as defined in claim 1 in which said central opening in said boss is tapered inwardly and downwardly from the top, and said holding screw has a head with a lower region tapered and dimensioned to have annular contact with the upper portion of said tapered opening in said boss whereby the said boss is cammed outward to exert a radial force on said ribs.

5. A cover plate for a carburetor body in which sealing gaskets are provided between the plate and the body which comprises:

a. a plate having peripheral and other surfaces to contact a gasket interposed between the plate and the body, b. an upstanding boss formed on said plate rising above the general surface thereof, said boss having an opening to receive a holding screw, c. a plurality of spaced ribs extending from the top portion of said boss to the periphery of said plate raised above the general surface of the plate and tapering downwardly to said surface near the outer edges, and d. a holding screw having a head with a surface to contact and apply a radial outward camming force on the upper portion of the wall of said opening in said boss and on said ribs to hold said plate on said carburetor when said screw is moved axially into said body, e. said boss being provided with slots between said ribs to allow the quadrant portions between the slots to expand radially to exert force on said ribs.

* * * * *